United States Patent [19]

Becker et al.

[11] 4,208,169

[45] Jun. 17, 1980

[54] IMPELLER FOR CENTRIFUGAL PUMPS

[75] Inventors: Karl-Heinz Becker, Worms; Hans-Dieter Knöpfel, Frankenthal; Alexander Nicklas, Bobenheim; Peter Hergt, Ludwigshafen; Engin Diler, Frankenthal, all of Fed. Rep. of Germany

[73] Assignee: Klein, Schanzlin & Becker Aktiengesellschaft, Frankenthal, Fed. Rep. of Germany

[21] Appl. No.: 795,561

[22] Filed: May 10, 1977

[30] Foreign Application Priority Data

Feb. 26, 1977 [DE] Fed. Rep. of Germany ..... 2708368

[51] Int. Cl.[2] ..... F04D 29/24

[52] U.S. Cl. ..... 416/185; 416/223 B; 415/213 B

[58] Field of Search ..... 416/185, 223 A, 224, 416/188, DIG. 2, 223 B, 178, 187; 415/213 R, 213A, 213 B

[56] References Cited

U.S. PATENT DOCUMENTS

| | | | |
|---|---|---|---|
| 978,753 | 12/1910 | Hurst | 416/224 |
| 1,755,321 | 4/1930 | Hendrickson | 416/224 |
| 2,888,244 | 5/1959 | Pekarek | 416/241 |
| 2,987,806 | 6/1961 | Pekarek | 29/156.8 |
| 3,564,689 | 2/1971 | Hirtenlechner | 29/156.8 |
| 3,751,179 | 8/1973 | Wassmann | 415/213 R X |
| 3,788,765 | 1/1974 | Rusak | 415/213 R |
| 3,904,308 | 9/1975 | Ribaud | 415/213 R X |
| 4,010,530 | 3/1977 | Delgrosso et al. | 29/156.8 B |

FOREIGN PATENT DOCUMENTS

| | | | |
|---|---|---|---|
| 897801 | 11/1953 | Fed. Rep. of Germany | 416/223 B |
| 1236779 | 6/1960 | France | 416/185 |
| 419544 | 11/1934 | United Kingdom | 416/185 |
| 741797 | 12/1955 | United Kingdom | 416/DIG. 2 |

*Primary Examiner*—Everette A. Powell, Jr.
*Attorney, Agent, or Firm*—Peter K. Kontler

[57] ABSTRACT

A radial or semiaxial impeller for centrifugal pumps has an annulus of vanes whose inlet edges are disposed at the periphery of a circle and are bounded by convex transition surfaces having small radii of curvature. The inner portions of the suction sides of vanes are bounded by flat or slightly curved surfaces which merge gradually into concave surfaces bounding the outer portions of the respective suction sides. The length of each flat or slightly curved surface is between 3 millimeters and the vane pitch. The ratio of the radii of curvature of transition surfaces at the inlet edges of the vanes to the vane pitch is between 0.0035 and 0.04 and/or the ratio of these radii to the average thickness of the inlet portion of a conventional vane is between 0.04 and 0.50. Such construction of the vanes reduces the likelihood of excessive erosion as a result of cavitation.

4 Claims, 1 Drawing Figure

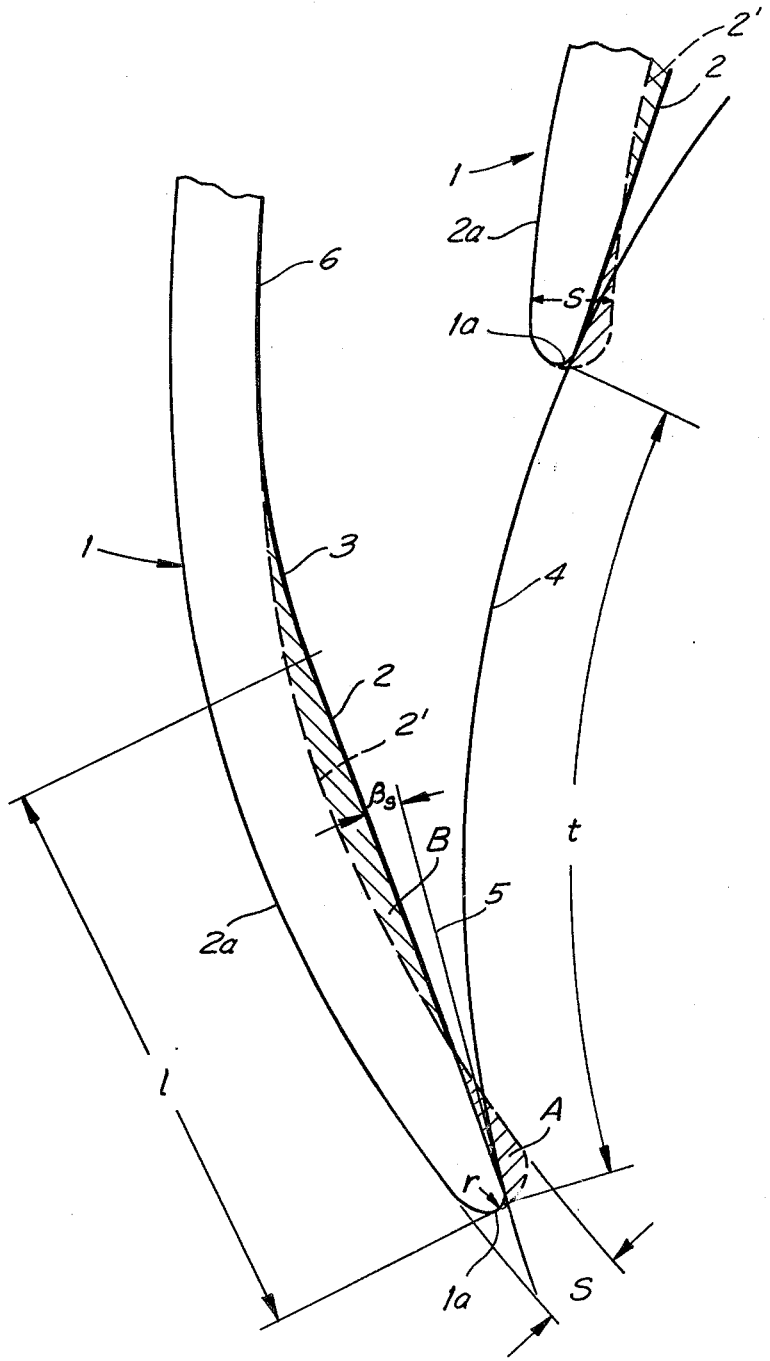
2'
2
1
2a
s
1a
6
1
3
4
2
2'
$\beta_g$
B
t
5
2a
l
A
r
1a
s

IMPELLER FOR CENTRIFUGAL PUMPS

BACKGROUND OF THE INVENTION

The present invention relates to impellers for centrifugal pumps in general, and more particularly to improvements in radial and/or semiaxial impellers. Still more particularly, the invention relates to improvements in the construction and design of vanes in radial or semiaxial impellers.

Recent types of centrifugal pumps with radial or semiaxial impellers are operated at a relatively high rotational speed. This presents problems in the region of inlet edges of the vanes, primarily due to more pronounced cavitation as a result of increased speed of fluid flow at the eye of the impeller. It has been found that implosion of vapor bubbles at the suction sides of vanes in the region of the respective inlet edges results in rapid and pronounced erosion of the material of the vanes. In many instances, the erosion is so pronounced that it causes a complete breakdown of operation of the pump. Presently known proposals to reduce or eliminate erosion which is attributable to cavitation at the suction sides of vanes in a radial or semiaxial impeller include the provision of means for improving the flow conditions in the eye of the impeller, e.g., by resorting to a larger booster pump or inducer, by resorting to geodetically higher situated vanes, by increasing the pressure in the deaerator or feedwater storage tank of a boiler feed pump above saturation pressure and/or by injection of cold water into the affected regions. A drawback of such conventional proposals is that the provision of aforementioned flow improving means contributes excessively to the bulk, cost and complexity of the fluid flow machine.

SUMMARY OF THE INVENTION

An object of the invention is to provide an impeller for centrifugal pumps, particularly a radial or semiaxial impeller, wherein the vanes are configurated and constructed in such a way that the cavitation-induced erosion at suction sides of the vanes is much less pronounced than in heretofore known impellers.

Another object of the invention is to provide novel and improved vanes for a radial or semiaxial centrifugal pump impeller.

A further object of the invention is to provide a simple and inexpensive method of converting a conventional radial or semiaxial impeller into an impeller of the above-outlined character.

An additional object of the invention is to provide a novel and improved radial or semiaxial impeller which can be used with advantage in existing centrifugal pumps.

One feature of the invention resides in the provision of a method of reducing cavitation at the suction sides of vanes in an impeller for centrifugal pumps, particularly in a radial or semiaxial impeller of the type wherein the inlet edges of the vanes are disposed at the periphery of a circle and each vane has a suction side bounded by a concave surface and a convex transition surface bounding the respective inlet edge. The method comprises the steps of removing material at the suction side of each vane in the region of the respective inlet edge and/or adding material in a second region which is immediately adjacent to the first mentioned region so that the inner portions of suction sides of the thus modified vanes are bounded by flat or slightly curved surfaces making an angle of between 0 and 5 degrees with tangents to the aforementioned circle at the respective inlet edges. The length of each flat surface is between 3 millimeters and the vane pitch.

The material removing step preferably includes reducing the radius of curvature of each convex surface to a value at which the ratio of the reduced radius to the thickness of a vane (in the region of the inner portion of the respective suction side and prior to the material removing and/or adding step) is between 0.04 and 0.50. The ratio of the reduced radius to the vane pitch is between 0.0035 and 0.04.

The novel features which are considered as characteristic of the invention are set forth in particular in the appended claims. The improved impeller itself, however, both as to its construction and the mode of making the same, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a fragmentary plan view of a cylindrical cascade of radial impeller vanes which are constructed in accordance with one specific embodiment of the invention, the removed and added portions of the vanes being indicated by hatching.

DESCRIPTION OF THE PREFERRED EMBODIMENTS

The drawing shows portions of two vanes 1 of a cascade of vanes in a radial impeller for centrifugal pumps. The outlines of the vanes which embody the invention are indicated by solid lines. It will be noted that the inlet edges 1*a* of the vanes 1 are disposed at the periphery of a circle 4 whose center is located on the axis of the impeller shaft, not shown. The reference character t denotes the vane pitch, i.e., the distance between the inlet edges 1*a* of two neighboring vanes 1. The suction sides of the vanes 1 have inner portions which are adjacent to the respective inlet edges 1*a* and are bounded by flat or slightly curved surfaces 2 each having a length 1. The reference character s denotes the thickness of a conventional vane at the respective inlet, and the reference character 2*a* denotes the convex surface bounding the pressure side of the respective vane. The convex surface 2*a* of the improved vane is identical with the convex surface at the pressure side of a conventional vane whose suction side is bounded by a pronounced concave surface 2'. It will be understood that the illustrated conventional vane (having the surface 2') is but one of many conventional vanes which can be converted into vanes 1 in accordance with the method of the present invention. The surface 2' is converted into the surface 2 by removing material from the illustrated conventional vane in the region A which is located at the inlet edge 1*a* and by adding material in the region B which is outwardly adjacent to the region A. The angle $\beta_s$ between the flat or slightly curved surface 2 and a tangent 5 to the circle 4 at the respective inlet edge 1*a* is between 0 and 5 degrees. It is clear that the extreme situation, where $\beta_s$ equals zero and t equals 1, is excluded from the above calculations.

The radius of curvature r of the convex surface at the inlet edge 1*a* of each vane 1 is selected in such a way that the ratio r:s is between 0.04 and 0.50 and that the ratio r:t is between 0.0035 and 0.04. The convex surface having the radius r merges gradually into the straight or slightly curved surface 2.

The outer portion of the suction side of each vane 1 is bounded by a concave surface 6 which merges gradually (as at 3) into the respective flat or slightly curved surface 2. The length 1 is measured from the point where the inlet edge 1*a* merges into the respective straight or slightly curved surface 2 to the innermost point of the region 3 of merger of the straight or slightly curved surface 2 into the surface 6.

A conventional vane can be configurated in such a way that it can be converted into the improved vane by removing material at A or by adding material at B. Also, the improved vane need not be obtained solely by conversion of conventional vanes, i.e., it can acquire the desirable shape during casting or another technique which is selected for the making of the impeller.

In the normal and part-load operation range of a centrifugal pump having a radial or semiaxial impeller, the pressure of liquid which flows against the suction sides of vanes in the region of the respective inlet edges is considerably less than the pressure in the eye of the impeller. Such pressure drop can reach a value at which the pressure at the suction sides of vanes equals the vaporization pressure of conveyed liquid. This results in development of vapor bubbles whose collapse entails rapid and pronounced erosion of material at the suction sides of the vanes. It has been found that the likelihood of pronounced pressure drop along the flat surfaces 2 of the improved vanes is negligible, especially when compared with the drop of pressure along the corresponding surfaces of vanes in a conventional radial or semiaxial impeller. In fact, the reduction of pressure drop in the improved impeller is so pronounced that vapor bubbles develop only when the pressure of liquid at the eye of the impeller is reduced to one-third of pressure which is needed to avoid cavitation at the suction sides of vanes in a conventional impeller. The just outlined feature of the improved impeller is desirable and advantageous because the outlay for auxiliary equipment at the inlet of the centrifugal pump can be reduced or eliminated altogether. Thus, a centrifugal pump which embodies the improved impeller can operate satisfactory with a relatively small booster pump or inducer; in many instances, the booster pump and/or the inducer can be dispensed with. This reduces the initial and maintenance cost of the system in which the centrifugal pump is put to use.

In accordance with certain recent proposals to improve the net positive suction head (NPSH) for the customary static head criteria of centrifugal pumps, the vanes of a radial or semiaxial impeller are provided with pointed inlet edges by flattening the suction and/or pressure sides of the vanes in immediate proximity of the respective inlet edges. However, it has been found that the effect of such configurations on incipient cavitation at the suction sides of the vanes is either negative or negligible. In other words, such proposals fail to exert a beneficial influence on the value of $NPSH_i$ (net positive suction head during the initial or incipient stage of cavitation). Flattening of pressure sides of the vanes entails an increase of the entry angle and of the cross-sectional areas of intake ends of the passages between neighboring vanes; this promotes the vapor absorbing capacity of the impeller, especially in the overload range of operation. If the vanes are flattened at the suction sides, the entry angle is reduced and the NPSH is improved during part-load operation but deteriorates in the overload range. The NPSH is improved during normal operation, as well as in the part-load and overload ranges, if the vanes are pointed symmetrically at both sides of their inlet edges.

The just outlined measures to improve the NPSH of the pump can be incorporated in the improved impeller subsequent to the aforedescribed removal and/or addition of material at the suction sides (see the regions A and B in the drawing). Such shaping for the purpose of improving the NPSH can be carried out irrespective of the selected original design duty point of the pump.

In the appended claims, the expression "substantially flat" is intended to denote absolutely flat as well as slightly curved surfaces 2. The maximum deviation of the surfaces 2 from an absolutely flat surface does not exceed 4 percent of the length 1. If the surfaces 2 are curved, they are concave surfaces.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. In an impeller for liquid-conveying centrifugal pumps, particularly in a radial or semiaxial impeller, an annulus of vanes having inlet edges disposed at the periphery of a circle, suction sides and pressure sides, the suction side of each of said vanes having an inner portion facing said circle; and means for making said vanes resistant to cavitation induced erosion, including a substantially flat surface of the inner portion of each of said vanes adjacent to the respective inlet edge, the respective flat surface making an angle of between 0 and 5 degrees with a tangent to said circle at the respective inlet edge, and having a length at least of 3 millimeters and at most equal to the vane pitch.

2. A structure as defined in claim 1, wherein the inlet edges of said vanes are bounded by convex surfaces and the ratio of the radii of curvature of said convex surfaces to the vane pitch is between 0.0035 and 0.04.

3. A structure as defined in claim 1, wherein the inlet edges of said vanes are bounded by convex surfaces and the ratio of the radii of curvature of said convex surfaces to the average thickness of the inner portion of a vane wherein such inner portion is bounded by a surface different from said substantially flat surface is between 0.04 and 0.50.

4. A structure as defined in claim 1, wherein the suction side of each of said vanes further includes an outer portion bounded by a concave surface which merges gradually into the respective substantially flat surface.

* * * * *